US011667006B2

(12) United States Patent
Werner

(10) Patent No.: US 11,667,006 B2
(45) Date of Patent: Jun. 6, 2023

(54) POLISHING MACHINE AND METHOD FOR POLISHING OPTICAL WAVEGUIDES

(71) Applicant: AMPHENOL PRECISION OPTICS GMBH, Sinn-Fleisbach (DE)

(72) Inventor: Christoph Werner, Bischoffen (DE)

(73) Assignee: AMPHENOL PRECISION OPTICS GMBH, Sinn-Fleisbach (DE)

( * ) Notice: Subject to any disclaimer, the term of this patent is extended or adjusted under 35 U.S.C. 154(b) by 473 days.

(21) Appl. No.: 16/499,346

(22) PCT Filed: Apr. 3, 2017

(86) PCT No.: PCT/EP2017/057885
§ 371 (c)(1),
(2) Date: Dec. 4, 2020

(87) PCT Pub. No.: WO2018/184658
PCT Pub. Date: Oct. 11, 2018

(65) Prior Publication Data
US 2021/0114161 A1 Apr. 22, 2021

(51) Int. Cl.
*B24B 19/22* (2006.01)
*B24B 53/017* (2012.01)

(52) U.S. Cl.
CPC ..... *B24B 19/226* (2013.01); *B24B 53/017* (2013.01)

(58) Field of Classification Search
CPC ... B24B 53/017; B24B 19/226; B24B 41/067; G02B 6/25; B24C 1/003
(Continued)

(56) References Cited

U.S. PATENT DOCUMENTS 6,012,968 A 1/2000 Lofaro
6,102,785 A * 8/2000 Chandler ..... B24B 19/226 451/271
(Continued)

FOREIGN PATENT DOCUMENTS

CN 106239356 A 12/2016
JP 2000354948 A * 12/2000
(Continued)

OTHER PUBLICATIONS

JP-2000354948-A—NPL Machine Translation (Year: 2000).*
(Continued)

*Primary Examiner* — Lee D Wilson
*Assistant Examiner* — Alberto Saenz
(74) *Attorney, Agent, or Firm* — Dickinson Wright PLLC; Andrew D. Dorisio

(57) ABSTRACT

The invention relates to a polishing machine (10) and to a method for polishing optical waveguides, the polishing machine comprising a polishing disk (13) having a plug socket (14) for holding a plug with an optical waveguide, a polishing platform (15) for receiving an abrasive, a positioning device (17) for relative positioning of the polishing disk and of the polishing platform between a polishing position and a set-up position (16), and a drive device for executing a relative polishing movement between the polishing platform and the polishing disk in the polishing position, wherein the polishing machine has a cleaning device for applying dry ice to the polishing platform and/or to the polishing disk.

18 Claims, 5 Drawing Sheets

(58) Field of Classification Search
USPC ..... 451/41
See application file for complete search history.

(56) References Cited

U.S. PATENT DOCUMENTS

| | | | | |
|---|---|---|---|---|
| 8,556,063 | B2 * | 10/2013 | Ficarra | B65G 45/22 198/494 |
| 10,068,602 | B2 * | 9/2018 | Tawara | C09K 3/1454 |
| 2006/0035562 | A1 * | 2/2006 | Sarfati | G02B 6/3863 451/41 |
| 2013/0203320 | A1 * | 8/2013 | Ghalambor | B24C 1/083 451/2 |
| 2017/0232572 | A1 * | 8/2017 | Brown | B24B 37/107 451/5 |

FOREIGN PATENT DOCUMENTS

| | | | | |
|---|---|---|---|---|
| JP | 2000354948 | A | 12/2000 | |
| WO | 2004056532 | A1 | 7/2004 | |
| WO | 2015049829 | A1 | 4/2015 | |
| WO | WO-2015049829 | A1 * | 4/2015 | B24B 37/08 |

OTHER PUBLICATIONS

WO-2015049829-A1—NPL Machine Translation (Year: 2005).*
English machine translation for CN106239356.
English machine translation for JP2000354948.
English machine translation for WO2015049829.

* cited by examiner

POLISHING MACHINE AND METHOD FOR POLISHING OPTICAL WAVEGUIDES

FIELD OF THE INVENTION

The invention relates to a polishing machine and to a method for polishing optical waveguides, the polishing machine comprising a polishing disk having a plug socket for holding a plug with an optical waveguide, a polishing platform for receiving an abrasive, a positioning device for relative positioning of the polishing disk and of the polishing platform between a polishing position and a set-up position, and a drive device for executing a relative polishing movement between the polishing platform and the polishing disk in the polishing position.

BACKGROUND OF THE INVENTION

Polishing machines and methods of this kind are sufficiently known and are typically employed to polish optical waveguides or, more precisely, an end of an optical fiber of an optical waveguide. The end of the optical fiber is received in a male connector or plug for the detachable connection of optical waveguides or fiber optic cables. These male connectors serve to establish a plug/plug connection or a plug/socket connection of optical waveguides. The plugs should exhibit as little signal loss as possible and high return loss, which is why the ends of the respective optical fibers are polished together with the respective plug ends, if applicable.

The known polishing machines always have a polishing disk, which forms a polishing attachment and which has fixing devices for the detachable attachment of plugs. A plug attached to an optical waveguide can be detachably attached to the polishing disk in a defined position using the fixing device, the polishing disk being arranged and moved relative to an abrasive layer of the polishing device during polishing. The abrasive layer can be an abrasive that is disposed on a polishing platform of the polishing machine. For example, the abrasive can be a web or sheet of paper or plastic with abrasive particles disposed thereon. The end of the optical fiber in the plug will come into contact with an abrasive layer on the polishing platform and will be polished through the relative movement of the polishing disk, a rinsing liquid typically being added.

Among other purposes, the rinsing liquid serves to cool the optical waveguide or plug and prevents rapid wear of the abrasive or abrasive layer due to wear debris from the plug and the optical waveguide, and it takes away loose abrasive particles from the abrasive layer, thus improving a quality of a polished surface of an optical waveguide.

DESCRIPTION OF THE INVENTION

Depending on its embodiment, the polishing machine can support a plurality of plugs on a polishing disk in order to polish them simultaneously and to thus be able to execute an economically advantageous polishing process. Hence, the polishing disk may also be provided with a plurality of plug sockets having passage openings for receiving an optical fiber or a plug with an optical fiber of an optical waveguide.

In the known polishing methods, a polishing machine is set up by manually attaching a number of plugs each having optical waveguides to a polishing disk, an abrasive or a polishing film or web having abrasive particles being placed on a polishing platform with a polishing pad made of rubber as a support, if needed. A person operating the polishing machine will manually wet the polishing platform or the abrasive located thereon with rinsing liquid. Depending on the type of the polishing machine, the polishing process can be performed by using a positioning device of the polishing machine to transfer the polishing disk from the set-up position into a polishing position, in which the fiber ends and/or the polishing platform are moved relative to the polishing disk by means of a drive device in such a manner that the fiber ends undergo a polishing movement on the polishing platform with the polishing film.

After some time, the polishing platform is returned to the set-up position and the abrasive or the polishing film having abrasive particles on the polishing platform is manually replaced. Since the plugs or the fiber ends and the polishing platform are covered with polishing residue and polluted rinsing liquid, the polishing disk and the polishing platform are typically wiped down with a cloth by the operator in order to ensure, in particular, that no larger abrasive particles remain on the plug ends and that a clean and smooth support surface is available on the polishing platform. Subsequently, a polishing pad with an abrasive having a finer abrasive grit is manually placed on the polishing platform and, after an addition of rinsing liquid, a new polishing process is started. This polishing process is repeated multiple times, each time using an abrasive with a finer abrasive grit than in a previous polishing process. A hardness of the polishing pad can also be varied. This means that the abrasive is changed, the polishing disk and the polishing platform are wiped down and rinsing liquid is added in the set-up position between polishing processes.

Therefore, the object of the present invention is to propose a polishing machine and a method for polishing optical waveguides that allow optical waveguides to be polished at low cost and with high quality.

This object is attained by a polishing machine having the features of claim 1 and a method having the features of claim 17.

The polishing machine according to the invention for polishing optical waveguides comprises a polishing disk having a plug socket for supporting a plug with an optical waveguide, a polishing platform for receiving an abrasive, a positioning device for relative positioning of the polishing disk and of the polishing platform between a polishing position and a set-up position, and a drive device for executing a relative polishing movement between the polishing platform and the polishing disk in the polishing position, wherein the polishing machine has a cleaning device for applying dry ice to the polishing platform and/or to the polishing disk.

The cleaning device of the polishing machine according to the invention can be used to clean the polishing platform and/or the polishing disk substantially without residue. With the dry ice, abrasives and other pollutants on the polishing platform and on the polishing disk, such as loose abrasive particles or material residue and wear debris from the plugs and from the optical waveguides, can be easily removed from the abrasive itself, from the polishing platform and/or from the polishing disk and the respective plugs. The cleaning device applies the dry ice to the respective surface, where the dry ice sublimates because of the significantly higher temperature of the surface, an increase in volume during transition to the gaseous state causing any pollutants to be separated from the surface and eliminated. The transition to the gaseous phase also prevents dry ice residue from remaining on the respective surfaces. Also, any rinsing liquid residue on these surfaces can be easily removed in this way. Compared to manual cleaning, such as using a cloth, a significantly improved cleaning result can be achieved in this way, which, in turn, leads to increased quality of a polishing result. Furthermore, the cleaning device can be used to perform automatic cleaning between polishing processes using different abrasives, which saves a person operating the polishing machine time, thus allowing the polishing machine to be operated in a more economically advantageous fashion.

The dry ice can consist of solid carbon dioxide ($CO_2$) particles. In particular, the solid particles can be crystals. The dry ice can also be what is known as $CO_2$ snow. In that case, application of the dry ice to the surfaces to be cleaned can preferably take place by way of a compressed air jet at a temperature of −78.9° C. This will locally undercool and embrittle a layer of pollutants on the respective surface. The solid particles of carbon dioxide penetrate the layer and sublimate, a volume of the carbon dioxide enlarged from the transition to the gaseous phase breaking up the layer and explosively separating it from the respective surface. The carbon dioxide disperses in gaseous form in the ambient air. The surfaces remain undamaged because the dry ice is relatively soft.

The cleaning device can have an application nozzle for dry ice, the application nozzle being usable to form a directed core jet of solid $CO_2$ particles and a shell jet of compressed air coaxially surrounding the core jet from liquid carbon dioxide and compressed air. The application nozzle can be a nozzle that is centrally supplied with liquid carbon dioxide, which is then discharged to an environment via a central nozzle opening. A ring gap for discharging compressed air can be formed around the nozzle opening, the shell jet thus formed sweeping the liquid carbon dioxide along, which freezes when expanded by the nozzle and turns into $CO_2$ particles or crystals. The shell jet can focus the core jet onto a surface, i.e. collimate it and direct it at the surface. This significantly improves a cleaning effect of the core jet, i.e. of the dry ice. Also, the compressed air of the shell jet can be used to discharge loosened pollutants to the ambient air. The shell jet can alternatively be formed with nitrogen ($N_2$).

The cleaning device can have a handling device 23 for movable positioning of the application nozzle in the set-up position between the polishing platform and the polishing disk. For example, the handling device can be realized in the manner of a single-joint or multi-joint arm which positions the application nozzle in a space between the polishing platform and the polishing disk in the set-up position. For instance, the handling device may also move the application nozzle along surfaces of the polishing platform and/or of the polishing disk, allowing the respective surface to be fully cleaned. This is particularly advantageous if the surface to be cleaned is relatively large compared to a surface portion that can be cleaned using an immobile application nozzle. Also, the handling device may move the application nozzle in such a manner that the polishing platform is cleaned first, followed by the polishing disk, or vice-versa. After cleaning, the handling device can remove the application nozzle from the space, allowing the polishing platform and the polishing disk to be moved into the polishing position relative to each other.

It is particularly advantageous for the cleaning device to have a plurality of application nozzles. In this case, larger surfaces can be cleaned in less time. For example, the polishing platform and the polishing disk can also be cleaned simultaneously if the application nozzles are disposed in such a manner that their core jets act in opposite directions. For example, the application nozzles can be disposed in a row so that a surface can be cleaned particularly effectively. If the cleaning device comprises a handling device, the application nozzles can be disposed on said handling device.

The cleaning device can have a nozzle array composed of application nozzles, in which case the application nozzles can be disposed adjacent and outside an edge of the polishing platform and/or of the polishing disk, and their respective cleaning jets can be directed at a surface of the polishing platform and/or of the polishing disk. The nozzle array can be designed separately or in combination with a handling device including additional application nozzles. For example, the nozzle array can be designed in such a manner that that the application nozzles are disposed adjacent to the edge and equidistant along a circumference of the polishing platform and/or of the polishing disk. The respective cleaning jets of the application nozzles can extend within a space between the polishing platform and the polishing disk in the set-up position and can be directed at the surface of the polishing platform and/or of the polishing disk in such a manner that substantially the entire surface can be cleaned by the respective cleaning jets. During a cleaning process, the application nozzles, which are disposed in the shape of a ring about the polishing platform and/or the polishing disk in that case, may also be moved along the edge, i.e. radially, or be pivoted axially. Furthermore, the polishing platform and/or the polishing disk may also be turned during a cleaning process so as to clean the respective surfaces as completely as possible by means of the cleaning jets.

A passage opening 24 through which the dry ice can be metered onto the polishing platform by means of the cleaning device can be formed in the polishing disk. Be means of the cleaning device, the dry ice can now be applied to the polishing platform having the abrasive placed thereon; alternatively, the abrasive can be arranged on the polishing platform together with a polishing pad. In principle, it is also possible for the dry ice to be applied directly to the polishing platform if there is no abrasive disposed on the polishing platform. In particular, a passage opening through which the cleaning device can apply the dry ice onto the polishing platform is formed in the polishing disk in this case. The passage opening is explicitly not realized as a passage opening for receiving a plug, i.e. as a passage opening of a plug socket, but as a passage opening distinct therefrom.

There may also be a plurality of passage openings formed in the polishing disk, through which the dry ice can be applied to the polishing platform by means of the metering device. This is particularly advantageous if dry ice is supposed to be applied in the polishing position because the dry ice can then be distributed evenly on the polishing platform or on the abrasive.

The cleaning device can have a liquid reservoir or dry ice reservoir, a metering pump, a supply line, a metering valve, an application nozzle and a controller for dry ice. The liquid reservoir can be a temperature-insulated tank for liquid carbon dioxide, for example. The metering pump can be used to pump and meter the carbon dioxide. The supply line can be used to supply the application nozzle with liquid carbon dioxide and compressed air. The metering valve can be used to meter or set an amount of dry ice or liquid carbon dioxide and compressed air. The controller can be used for open-loop and closed-loop control of the components mentioned. The controller can also be formed by a control device present already for controlling the polishing machine.

The liquid reservoir or the dry ice reservoir, the metering pump, the supply line, the metering valve and the application nozzle can form a modular cleaning unit which can be removably disposed outside or within a housing of the polishing machine. This allows a conventional polishing machine to be retrofitted with the cleaning unit or allows a polishing machine to be configured in such a manner from the start that the cleaning unit can be easily added to it. Furthermore, the cleaning unit can be easily replaced with a new cleaning unit in the event of a defect in this case.

The positioning device can have a holder, the holder can have a mount for detachably holding the polishing disk, and the mount can be realized with a magnet for force-fitting support and/or with a coupling for form-fitting support of the polishing disk. The positioning device can have an arm or a boom at whose end the holder is formed. The arm or boom can be of such a design that a contact pressure between the polishing disk and the polishing platform is determined using said arm or boom. This may happen using a bending beam having strain gauges in the boom, allowing a dead weight of the polishing disk to be measured. Moreover, this also allows measuring a force with which the positioning device presses the polishing disk onto the polishing platform to be measured. Based on said force, a polishing force can be calculated and controlled as needed. The mount on the holder also allows the polishing disk to be detached from the positioning device or arm or boom and to be replaced, if required. The mount can be formed by magnets which hold the polishing disk in a force-fitting manner. The magnet can be a permanent magnet or an electromagnet. The polishing disk itself can have a magnet or be made of a ferromagnetic material. Alternatively or additionally, the mount can be a coupling for supporting the polishing disk in a form-fitting manner. For example, an axis disposed on the polishing disk can be plugged into the mount. Said axis can lock with the mount or coupling or, optionally, be wedged or clamped in the mount or coupling, allowing the coupling to hold the axis in a force-fitting manner, as well. If a passage opening is formed in the polishing disk, a supply line can also be routed to the polishing disk on or through the mount.

The mount can permit an inclination of the polishing disk at an angle of up to 2° relative to the polishing platform, the positioning device having a force gauge for determining a contact pressure between the polishing disk and the polishing platform. Accordingly, the polishing disk can swing by said angle when mounted on the mount. This helps ensure that the polishing disk always aligns with the polishing platform and a polishing force is distributed evenly across the polishing disk. The force gauge can be formed within the holder, such as by a bending beam having strain gauges.

The polishing disk can comprise a connecting protrusion to which the mount can be detachably connected. The connecting protrusion can be realized in the manner of an axis that is attached to the polishing disk. In this case, the axis can simply be plugged into the mount.

A channel for conducting dry ice to a passage opening of the polishing disk can be formed in the mount. If a connecting protrusion is disposed on the polishing disk, the channel can also connect to the connecting protrusion and be routed through it toward the passage opening of the polishing disk. Alternatively, the channel can also end at the mount without being connected to the polishing disk directly. In this case, the polishing disk can be positioned in the mount in such a manner that the channel always ends above a passage opening in the polishing disk, for example.

The polishing machine can have a metering device for applying rinsing liquid to the polishing platform, in which case a passage opening through which the rinsing liquid can be metered onto the polishing platform by means of the metering device can be formed in the polishing disk. By means of the metering device, the rinsing liquid can now be applied to the polishing platform having the abrasive placed thereon; alternatively, the abrasive can be arranged on the polishing platform together with a polishing pad. In principle, it is also possible for the rinsing liquid to be applied directly to the polishing platform if there is no abrasive disposed on the polishing platform. In particular, a passage opening through which the metering device can meter or apply the rinsing liquid onto the polishing platform is formed in the polishing disk in that case.

This allows the rinsing liquid to be applied to the polishing platform and thus also to the abrasive not only in the set-up position but also in the polishing position even if a polishing movement is being executed between the polishing platform and the polishing disk. Thus, the actual polishing process can be used to apply the rinsing liquid by means of the metering device, which means that this process does not have to be performed during set-up of the polishing machine. On the whole, this allows the set-up process between different polishing processes to be shortened, which saves the person operating the polishing machines time and allows the polishing machine to be operated in an even more economically advantageous fashion. Since the rinsing liquid can also be applied to the polishing platform or to the abrasive disposed on the polishing platform through the passage opening during a polishing process, an amount of rinsing liquid can also be metered out by the metering device during the entire polishing process. This helps ensure that a sufficient amount of rinsing liquid is present on the abrasive or on the polishing platform at all times during the polishing process. Depending on how the rinsing liquid is metered, particles of the abrasive and material residue or wear debris from the plugs and from the optical waveguides can be prevented from interfering with a polishing effect of the abrasive. A quality of the polished surface can be significantly improved in this way.

An atomizer valve of the metering device can be disposed at the passage opening. Using an atomizer valve, rinsing liquid can be sprayed across a large area of the polishing platform. For instance, the entire abrasive can be wetted with the rinsing liquid in this way. Depending on the number of passage openings, more than one atomizer valve may be provided.

At least part of polishing disk and/or of the polishing platform can be coated with an amorphous carbon layer. For example, the amorphous carbon layer can be applied by DLC coating, in which case a surface of the polishing disk and/or of the polishing platform can be fully coated with the amorphous carbon layer. A coating of this kind has a smooth surface with high wear resistance. In particular, a coating of this kind can have a hardness of about 2,500 to 3,000 HV. Moreover, the coating is black in color, making any damage or wear of the coating easy to detect. A service life of the polishing disk and/or of the polishing platform can be significantly prolonged in this way. In particular, the material of the polishing disk and/or of the polishing platform no longer has to be multi-coated in order to achieve a desired hardness of the surface of the polishing disk and/or of the polishing platform. Heat treatment of the polishing disk and/or of the polishing platform can be significantly simplified in this way. On the whole, this eliminates a series of process steps for producing the polishing disk and/or the polishing platform, making production more cost-effective.

Advantageously, the polishing machine can have a changer device, wherein the changer device can comprise a plurality of polishing pads each having an abrasive, wherein the abrasives can be different from each other, wherein the polishing pads with the abrasives can be stored in a magazine of the changer device and can each be arranged on and removed from the polishing platform by means of a handling device of the changer device. For example, the polishing pads can also be different from each other if the polishing pads are made of rubber and have different hardness values. The abrasives can differ in abrasive particle size, i.e. grit, and can be positioned on the polishing pads suitable in each case. The magazine can store a plurality of polishing pads each having abrasives. For example, the magazine can be realized as a circulating belt or a chain in the manner of a paternoster in which the polishing pads with the abrasives are placed or held. The handling device can be a robot arm, a conveyor belt or another suitable device by means of which a polishing pad with an abrasive located on the polishing platform can be exchanged for a polishing pad with an abrasive in the magazine. This also allows polishing pads each having abrasives to be exchanged fully automatically for the execution of a multi-stage polishing process. However, this is not possible unless the polishing platform and/or the polishing disk can be cleaned automatically by application of dry ice by means of the cleaning device.

In the method according to the invention for polishing optical waveguides using a polishing machine, an end of an optical fiber of an optical waveguide is polished, a plug with the optical waveguide being held in a plug socket of a polishing disk, an abrasive being received on a polishing platform, the polishing disk and the polishing platform being moved relative to each other from a set-up position into a polishing position by means of a positioning device, the polishing disk and the polishing platform being moved relative to each other in a polishing movement by a drive device when in the polishing position, dry ice being applied to the polishing platform and/or to the polishing disk by means of a cleaning device of the polishing machine. Regarding the advantages of the method according to the invention, reference is made to the description of advantages of the device according to the invention.

Dry ice can be applied before and/or after execution of a polishing movement, preferably in the set-up position. This allows the abrasive or the polishing platform and the polishing disk to be cleaned after a polishing process in order to prepare for a subsequent polishing process, for example.

The dry ice can sublimate at a surface of the polishing platform and/or of the polishing disk, and pollutants of the surface can be removed from the surface. The pollutants may be rinsing liquid residue or dirt particles from plugs, optical waveguides and the abrasive, for example. In this way, said dirt particles can also be prevented from being carried over into a subsequent polishing process, whereby a quality of the respective polished surfaces can be improved significantly. The sublimation of the dry ice can enlarge a volume of the dry ice by a factor of about 700 to 1,000 during the transition to the gaseous phase, the pollutants being transported away from the respective surfaces into an environment of the polishing platform and of the polishing disk. For example, the pollutants can also be collected and discharged easily by means of a suction device of the polishing machine, which can surround at least part of the polishing platform and/or of the polishing disk.

Brief Description of the Drawing Figures

Figure 1:
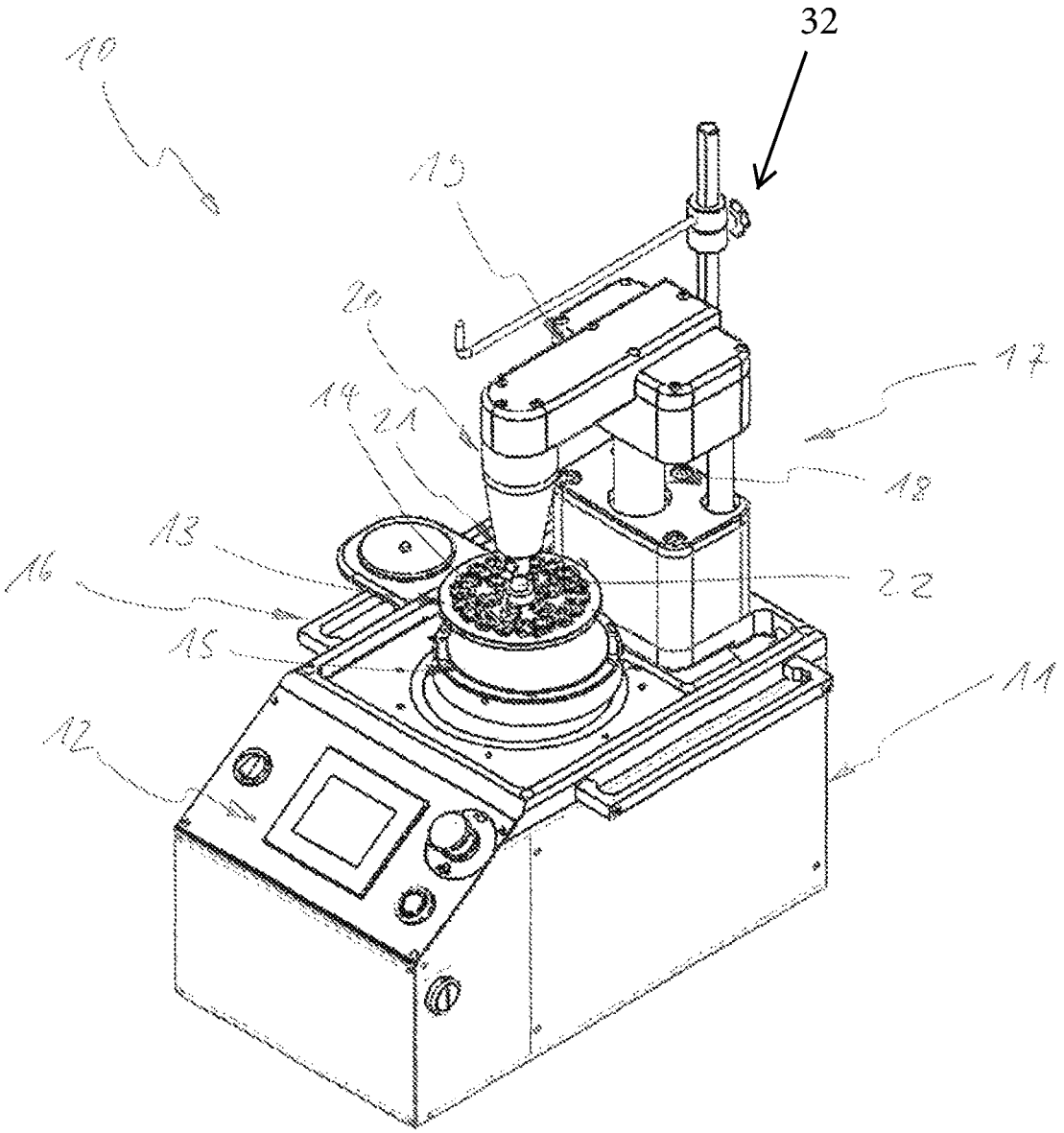
FIG. 1 is a front perspective view of a polishing machine according to the disclosure.

Hence, in particular, a flow of used cleaning gas which flows from a center toward an edge of the polishing platform and/or of the polishing disk may be formed. For example, the dry ice may be applied in the center or middle of the polishing platform and/or of the polishing disk, causing gas produced by sublimation to expand from the center toward the edge. The dry ice can also be applied to an edge of the polishing platform and/or of the polishing disk in such a manner that opposite flows of used cleaning gases meet in the center and hit the opposite center of the polishing platform or of the polishing disk, from where they are discharged toward the edge.

By means of a controlling device of the polishing machine, relative positioning of the polishing disk and of the polishing platform, changing of polishing pads, execution of the polishing movement and/or metering of the rinsing liquid can be controlled. In principle, the controlling device can also be used to control other functions of the polishing machines. By using the controlling device, a polishing process or a sequence of polishing processes can be executed fully automatically. In addition to a metering of rinsing liquid, rinsing liquid may be metered in order to obtain high-quality polished surfaces.

If the polishing machine has a metering device, the controlling device can also be used to control a metering function of the polishing machine.

Advantageous embodiments of the method are apparent from the description of features of the claims dependent on device claim 1.

Hereinafter, a preferred embodiment of the invention will be explained in more detail with reference to the accompanying drawing.

FIGS. 1, 2, 3, 4, and 5 show a polishing machine 10 for polishing optical waveguides, polishing machine 10 comprising a housing 11 and a controlling device 12 for controlling a function of polishing machine 10. In particular, polishing machine 10 has a polishing disk 13 comprising a plurality of plug sockets 14. Polishing disk 13 is disposed opposite a polishing platform 15 of polishing machine 10 and is shown positioned in a set-up position 16 relative to polishing platform 15. A drive device (not shown) located in housing 11 can drive polishing platform 10 in a circular movement relative to polishing disk 13. A polishing pad (not shown) with an abrasive can be placed on polishing platform 15.

A positioning device 17 of polishing machine 10 has a linearly displaceable column 18 comprising an arm 19 and a holder 20 for holding polishing disk 13. Holder 20 forms a mount 21 for detachably holding polishing disk 13. An axis 22 that can be plugged into mount 21 is formed on polishing disk 13.

Polishing machine 10 has a cleaning device comprising a cleaning unit 23 for applying dry ice to polishing platform 15 and/or polishing disk 13. By means of the cleaning device, any pollutants adhering to polishing disk 13 and polishing platform 15 can be eliminated without residue in the set-up position 16 shown.

Furthermore, polishing machine 10 can have a metering device including a metering pump 28 by means of which rinsing liquid can be metered onto polishing platform 15 having the abrasive placed thereon. Rinsing liquid is supplied through a passage opening (not shown) in polishing platform 15, allowing rinsing liquid to also be applied during a polishing process.

Figure 2:
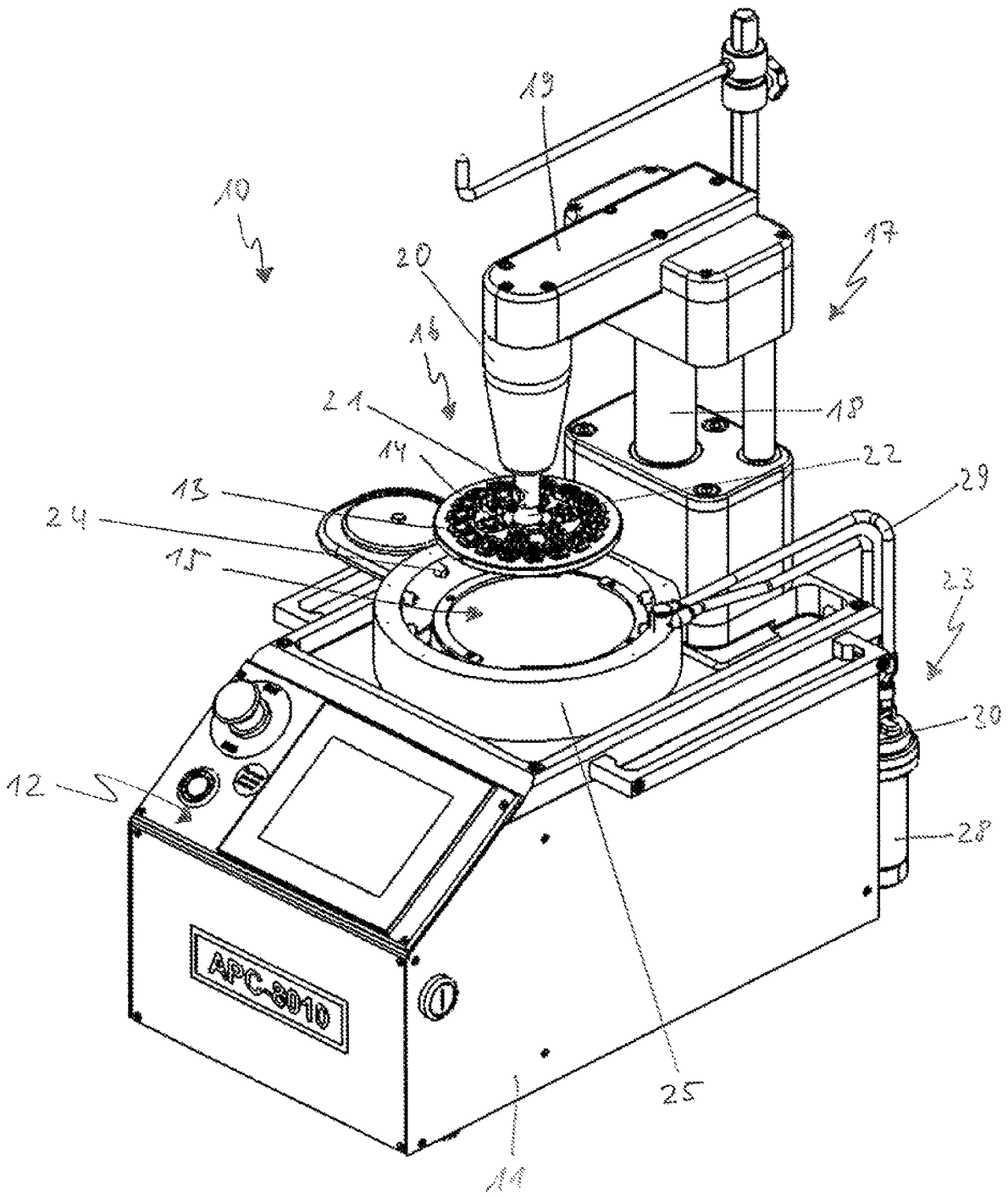
FIG. 2 is a front perspective view of the polishing machine including an array of application nozzles.
Figure 3:
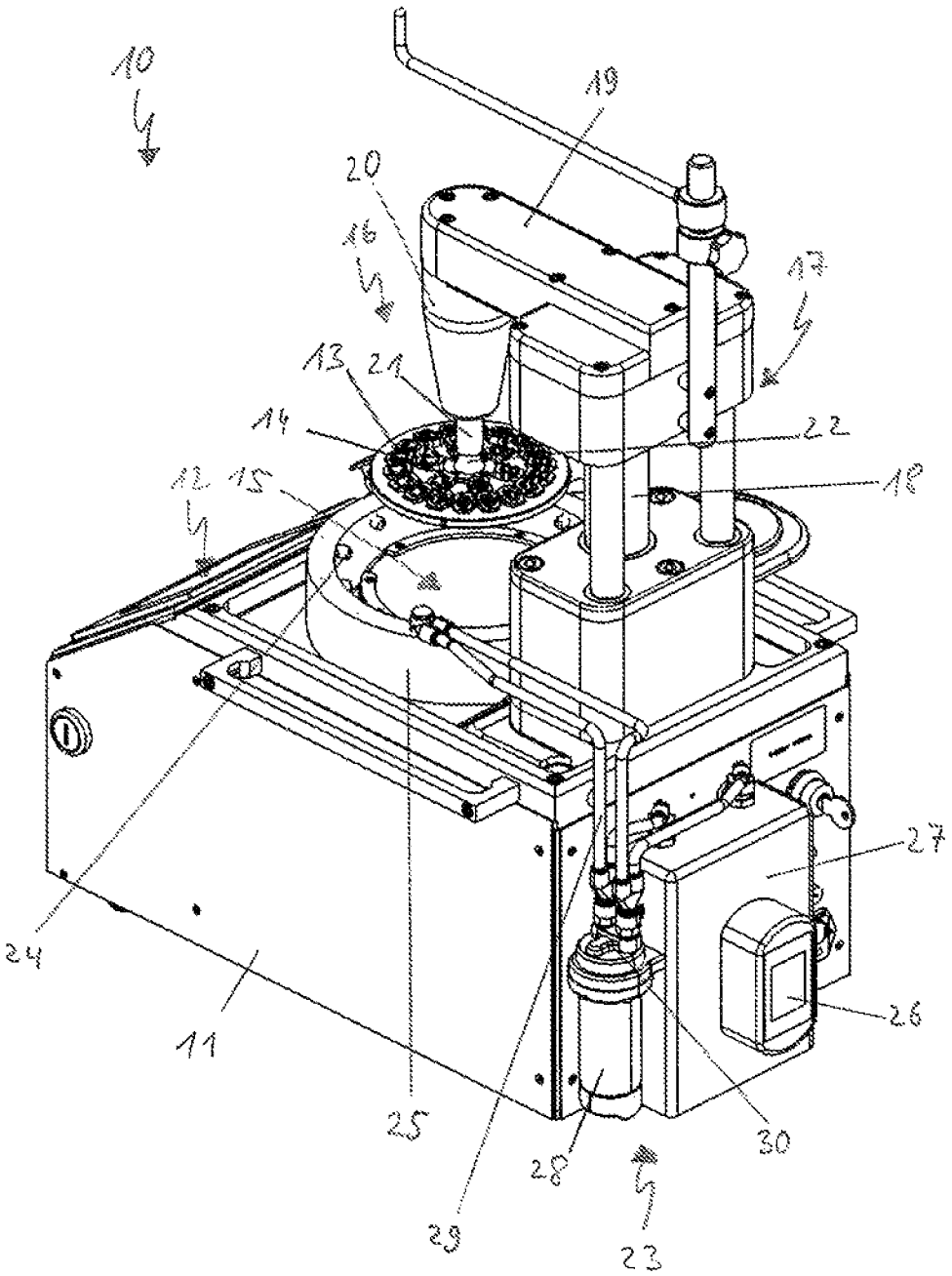
FIG. 3 is a rear perspective view of the polishing machine of FIG. 2.
Figure 4:
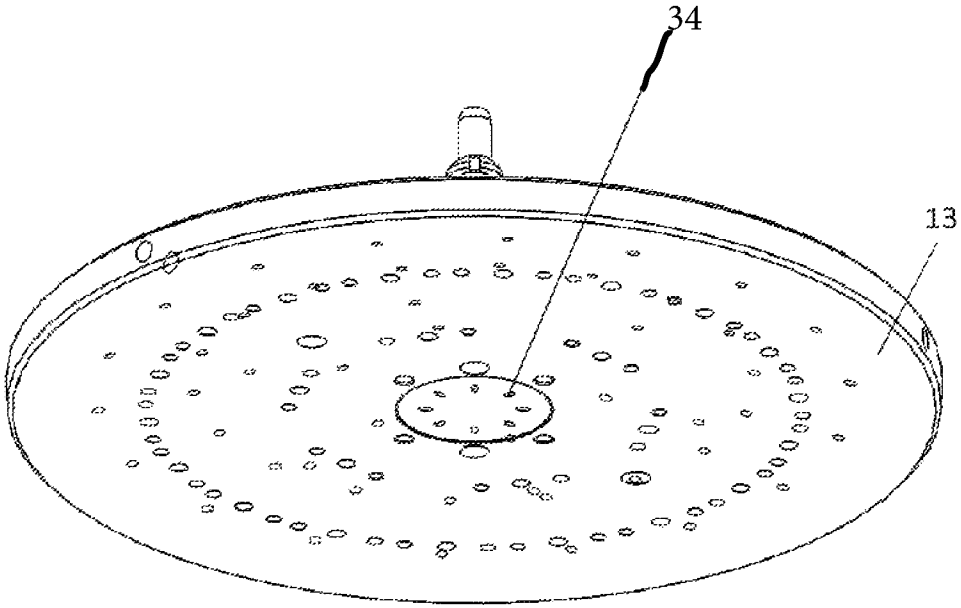
FIG. 4 is a lower perspective view of a polishing disk of the polishing machine of FIG. 1.
Figure 5:
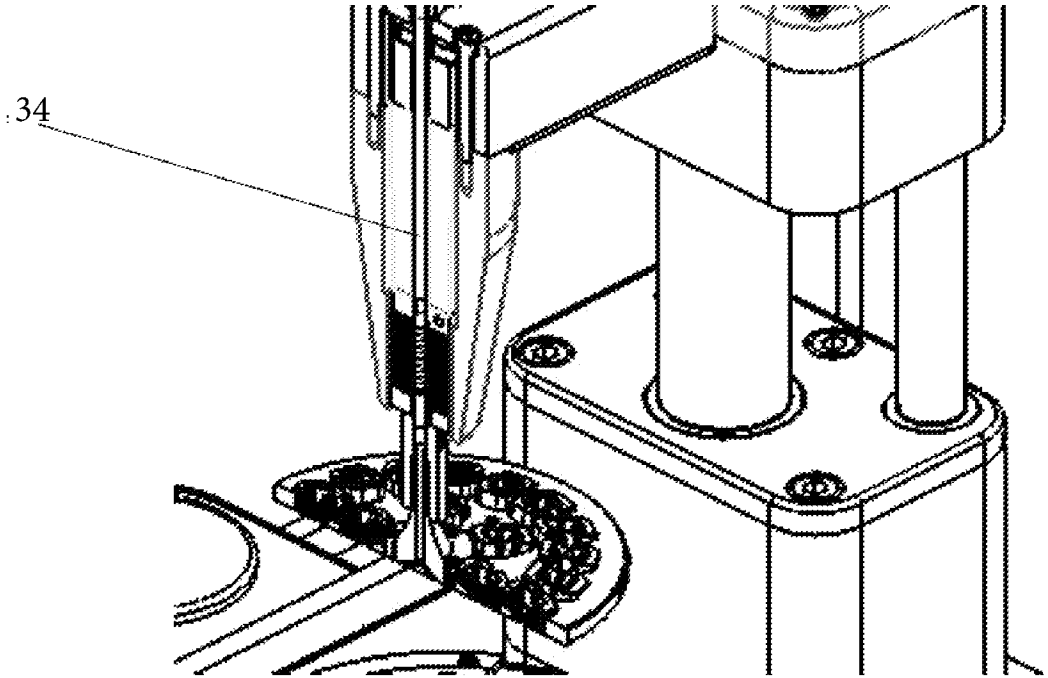
FIG. 5 is a cross-sectional view of the polishing machine of FIG. 1 including a passage opening.

It is particularly advantageous for the cleaning device to have a plurality of application nozzles 24, as shown in FIGS. 2 and 3. In this case, larger surfaces can be cleaned in less time. For example, the polishing platform 15 and the polishing disk 13 can also be cleaned simultaneously if the application nozzles 24 are disposed in such a manner that their core jets act in opposite directions. For example, the cleaning device can have a nozzle array 25 composed of application nozzles 24, in which case the application nozzles can be disposed adjacent and outside an edge of the polishing platform 15 and/or of the polishing disk 13, and their respective cleaning jets can be directed at a surface of the polishing platform 15 and/or of the polishing disk 13. The nozzle array 25 can be designed in such a manner that that the application nozzles 24 are disposed adjacent to the edge and equidistant along a circumference of the polishing platform 15 and/or of the polishing disk 13. The respective cleaning jets of the application nozzles 24 can extend within a space between the polishing platform 15 and the polishing disk 13 in the set-up position and can be directed at the surface of the polishing platform 15 and/or of the polishing disk 13 in such a manner that substantially the entire surface can be cleaned by the respective cleaning jets. During a cleaning process, the application nozzles 24, which are disposed in the shape of a ring about the polishing platform 15 and/or the polishing disk 13 in that case, may also be moved along the edge, i.e. radially, or be pivoted axially. Furthermore, the polishing 15 platform and/or the polishing disk 13 may also be turned during a cleaning process so as to clean the respective surfaces as completely as possible by means of the cleaning jets.

As also shown in FIGS. 2 and 3, the cleaning device 23 can have a liquid reservoir or dry ice reservoir 27, a metering pump 28, a supply line 29, a metering valve 30, an application nozzle 24 and a controller 26 for dry ice. The reservoir 27 can be a temperature-insulated tank for liquid carbon dioxide, for example. The metering pump 28 can be used to pump and meter the carbon dioxide. The supply line 29 can be used to supply the application nozzle 24 with liquid carbon dioxide and compressed air. The metering valve 30 can be used to meter or set an amount of dry ice or liquid carbon dioxide and compressed air. The controller 26 can be used for open-loop and closed-loop control of the components mentioned. The controller 26 can also be formed by a control device 12 present already for controlling the polishing machine 10.

The liquid reservoir or the dry ice reservoir 27, the metering pump 28, the supply line 29, the metering valve 30 and the application nozzle 24 can form a modular cleaning unit 23 which can be removably disposed outside a housing of the polishing machine 10, as shown in FIGS. 2 and 3. This allows a conventional polishing machine to be retrofitted with the cleaning unit 23 or allows a polishing machine to be configured in such a manner from the start that the cleaning unit 23 can be easily added to it. Furthermore, the cleaning unit 23 can be easily replaced with a new cleaning unit in the event of a defect in this case.

The invention claimed is:

1. A polishing machine for polishing optical waveguides, comprising a polishing disk having a plug socket for holding a plug with an optical waveguide, a polishing platform for receiving an abrasive, a positioning device for relative positioning of the polishing disk and of the polishing platform between a polishing position and a set-up position, the polishing machine adapted for executing a relative polishing movement between the polishing platform and the polishing disk in the polishing position, characterized in that the polishing machine has a cleaning device for applying dry ice to the polishing platform or to the polishing disk;

the cleaning device has a nozzle array composed of application nozzles, the application nozzles being disposed adjacent and outside an edge of the polishing platform or of the polishing disk, the application nozzles being spaced equidistantly along a circumference of the polishing platform or the polishing disk, and respective cleaning jets of the application nozzles being directed at a surface of the polishing platform or of the polishing disk;

further including a liquid reservoir or dry ice reservoir, a metering pump, a supply line, a metering valve and at least one application nozzle of the application nozzles form a modular cleaning unit removably disposed outside or within a housing of the polishing machine.

2. The polishing machine according to claim 1, characterized in that the dry ice comprises solid carbon dioxide particles.

3. The polishing machine according to claim 1, characterized in that the cleaning device has an application nozzle of the application nozzles for dry ice, the application nozzle being usable to form a directed core jet of solid particles and a shell jet of compressed air coaxially surrounding the core jet from liquid carbon dioxide and compressed air.

4. The polishing machine according to claim 3, characterized in that the cleaning device has a handling device for movably positioning the application nozzle in the set-up position between the polishing platform and the polishing disk.

5. The polishing machine according to claim 3, characterized in that the cleaning device has a plurality of application nozzles of the application nozzles.

6. The polishing machine according to claim 1, characterized in that a passage opening through which the dry ice is metered onto the polishing platform by means of the cleaning device is formed in the polishing disk.

7. The polishing machine according to claim 1, characterized in that the positioning device has a holder, the holder having a mount for detachably holding the polishing disk, the mount being realized with a magnet for force-fitting holding or with a coupling for form-fitting holding of the polishing disk.

8. The polishing machine according to claim 7, characterized in that the mount permits an inclination of the polishing disk at an angle of up to 2° relative to the polishing platform, the positioning device having a force gauge for determining a contact pressure between the polishing disk and the polishing platform.

9. The polishing machine according to claim 7, characterized in that the polishing disk comprises a connecting protrusion which is detachably connectable to the mount (21).

10. The polishing machine according to claim 7, characterized in that a channel for conducting dry ice to a passage opening of the polishing disk is formed in the mount.

11. The polishing machine according to claim 1, characterized in that the polishing machine has a metering device for applying rinsing liquid to the polishing platform, a passage opening through which the rinsing liquid is metered onto the polishing platform by means of the metering device being formed in the polishing disk.

12. The polishing machine according to claim 1, characterized in that at least part of the polishing disk or of the polishing platform is coated with an amorphous carbon layer.

13. The polishing machine according to claim 1, characterized in that the polishing machine has a changer device, the changer device comprising a plurality of polishing pads each having an abrasive, the abrasives being different from each other, the polishing pads with the abrasives being stored in a magazine of the changer device and being arranged on and removed from the polishing platform by means of a handling device of the changer device.

14. A method for polishing optical waveguides using a polishing machine, an end of an optical fiber of an optical waveguide being polished, a plug with the optical waveguide being held in a plug socket of a polishing disk, an abrasive being received on a polishing platform, the polishing disk and the polishing platform being moved relative to each other from a set-up position into a polishing position by means of a positioning device, the polishing disk and the polishing platform being moved relative to each other in a polishing movement when in the polishing position;

wherein the method includes:

applying dry ice to the polishing platform or to the polishing disk by means of a cleaning device having a nozzle array composed of application nozzles, the application nozzles being disposed adjacent an edge of the polishing platform or of the polishing disk, the application nozzles being spaced equidistantly along a circumference of the polishing platform or the polishing disk, and respective cleaning jets of the application nozzles being directed at a surface of the polishing platform or of the polishing disk, and further including a dry ice reservoir, a metering pump, a supply line, a metering valve and at least one application nozzle forming a modular cleaning unit removably disposed outside a housing of the polishing machine.

15. The method according to claim 14, characterized in that dry ice is applied before or after execution of a polishing movement.

16. The method according to claim 14, characterized in that the dry ice sublimates at a surface of the polishing platform or of the polishing disk and pollutants of the surface are removed from the surface.

17. The method according to claim 14, characterized in that a flow of used cleaning gas is formed, which flows from a center toward an edge of the polishing platform or of the polishing disk.

18. The method according to according to claim 14, characterized in that relative positioning of the polishing disk and of the polishing platform, changing of polishing pads, execution of the polishing movement or metering of the dry ice is controlled by means of a control device of the polishing machine.

* * * * *